US005628513A

United States Patent [19]

Soriano

[11] Patent Number: 5,628,513

[45] Date of Patent: May 13, 1997

[54] PUZZLE/PLAY SET TOY PRODUCT

[76] Inventor: Rene Soriano, 152 Dodge St., Beverly, Mass. 01915

[21] Appl. No.: 583,850

[22] Filed: Jan. 11, 1996

[51] Int. Cl.[6] ..... A63F 9/10

[52] U.S. Cl. ..... 273/157 R

[58] Field of Search ..... 273/157 R, 153 R, 273/156

[56] References Cited

U.S. PATENT DOCUMENTS 1,976,664 10/1934 Gantt ..... 273/157 R

*Primary Examiner*—William H. Grieb
*Attorney, Agent, or Firm*—Brian M. Dingman

[57] ABSTRACT

A puzzle/play set toy product, comprising a plurality of separate puzzle/play set pieces, each piece representing an entire object or figure and having a top, a bottom, and sides, with a thickness and a bottom shape that together allow each piece to be free-standing vertically on its bottom, so that each piece can be separately played with, in which at least some of the pieces also have a top shape and thickness that allow them to support one or more other pieces above them, and in which a number of the pieces interfit with other pieces along their adjacent sides, to form a multiple-layer scene made up of the plurality of objects or figures represented by the plurality of separate pieces, the scene being capable of standing vertically unsupported.

5 Claims, 2 Drawing Sheets

PUZZLE/PLAY SET TOY PRODUCT

FIELD OF INVENTION

This invention relates to a child's puzzle in which each puzzle piece is able to stand on its own so that the pieces can also be used as a play set.

BACKGROUND OF INVENTION

Puzzles are well known toys and games. Knob puzzles are designed for very young children from ages one to three years. The pieces are relatively large, and each piece has attached to it a knob or handle to facilitate handling by the young children. The pieces typically fit within a frame with an appropriately-shaped cut out portion. The pieces have gentle curves so that they touch along adjacent curvilinear portions, but are very simple to place down in and remove from the frame. The pieces are usually designed with graphics so that each piece represents a portion of an overall scene which is displayed when the entire puzzle is put together.

Older children and adults have sufficient manual dexterity to master jigsaw puzzles. The puzzle pieces are usually cut from relatively thin cardboard, and are interlocking so that they can stay together without the need for a frame as used in the knob puzzles. Because the pieces interlock, each piece must be pushed into place in to one or more adjacent puzzle pieces. Much of the challenge associated with jigsaw puzzles relates to the fact that each piece carries only a very small portion of the overall scene made up by the entire puzzle.

Both the knob puzzles and jigsaw puzzles are stimulating toy products. Each of these products, however, has only a single use—that of a puzzle that must be put together either within a pre-formed frame or on a horizontal surface such as a table top. As these toys offer virtually no flexibility, they are not good creativity developers.

SUMMARY OF THE INVENTION

It is therefore an object of this invention to provide a toy product that can be used as both a puzzle and a play set.

It is a further object of this invention to provide such a toy product that stimulates creativity in children.

It is a further object of this invention to provide such a toy product that does not require a frame, or interlocking pieces.

It is a further object of this invention to provide such a toy product that does not require the manual dexterity necessary for a jigsaw puzzle.

It is a further object of this invention to provide such a toy product in which each separate piece of the product is also a toy that can be played with individually, or as a group.

This invention features a puzzle/play set toy product which in one embodiment includes a number of separate puzzle/play set pieces, each piece representing an object or figure, and having a top, a bottom, and sides. Each piece has a bottom shape and a thickness that together allow the pieces to be free-standing so that each piece can be separately played with. Some or all of the pieces also have a top shape and thickness that allow them to support one or more other pieces. The pieces interfit along their adjacent sides to form a multiple-layer scene made up of the objects and/or figures represented by the toy product pieces, in which the entire scene is capable of standing vertically unsupported.

To accomplish these objectives, the toy product is preferably made from material which has a thickness of at least approximately ½". It has been found that if the product is made from wood, a thickness of at least approximately ⅝" is sufficient to allow the pieces to stand vertically, and also to allow the entire assembled puzzle to stand vertically unsupported.

BRIEF DESCRIPTION OF THE DRAWINGS

Other objects, features and advantages will occur to those skilled in the art from the following description of a preferred embodiment, and the accompanying drawings, in which.

DESCRIPTION OF THE PREFERRED EMBODIMENT

This invention may be accomplished in a puzzle/play set toy product in which each piece has printing or other indicia that represents an entire object or figure, and which, when put together, form an integrated scene. In the preferred embodiment shown and described, the scene is Noah's Ark with a number of pairs of animals.

As is explained in more detail below, the; product is made from a relatively thick material. The combination of the thickness, the bottom shape, and the overall shape and balance of each piece is such that each piece cart stand separately unsupported on a hard flat surface, so that the product can also be used as a play set comprising a number of separate pieces, each representing an object or figure.

Another feature of the toy product is that it is designed to stand vertically unsupported when put together as a puzzle. This is accomplished at least in part by shaping the tops of at least all the pieces that form the layers below the top layer of the product in such a manner that they are capable of supporting one or more pieces above them. The product can thus be assembled as a puzzle to make up an entire scene, either horizontally or vertically.

Figure 1:
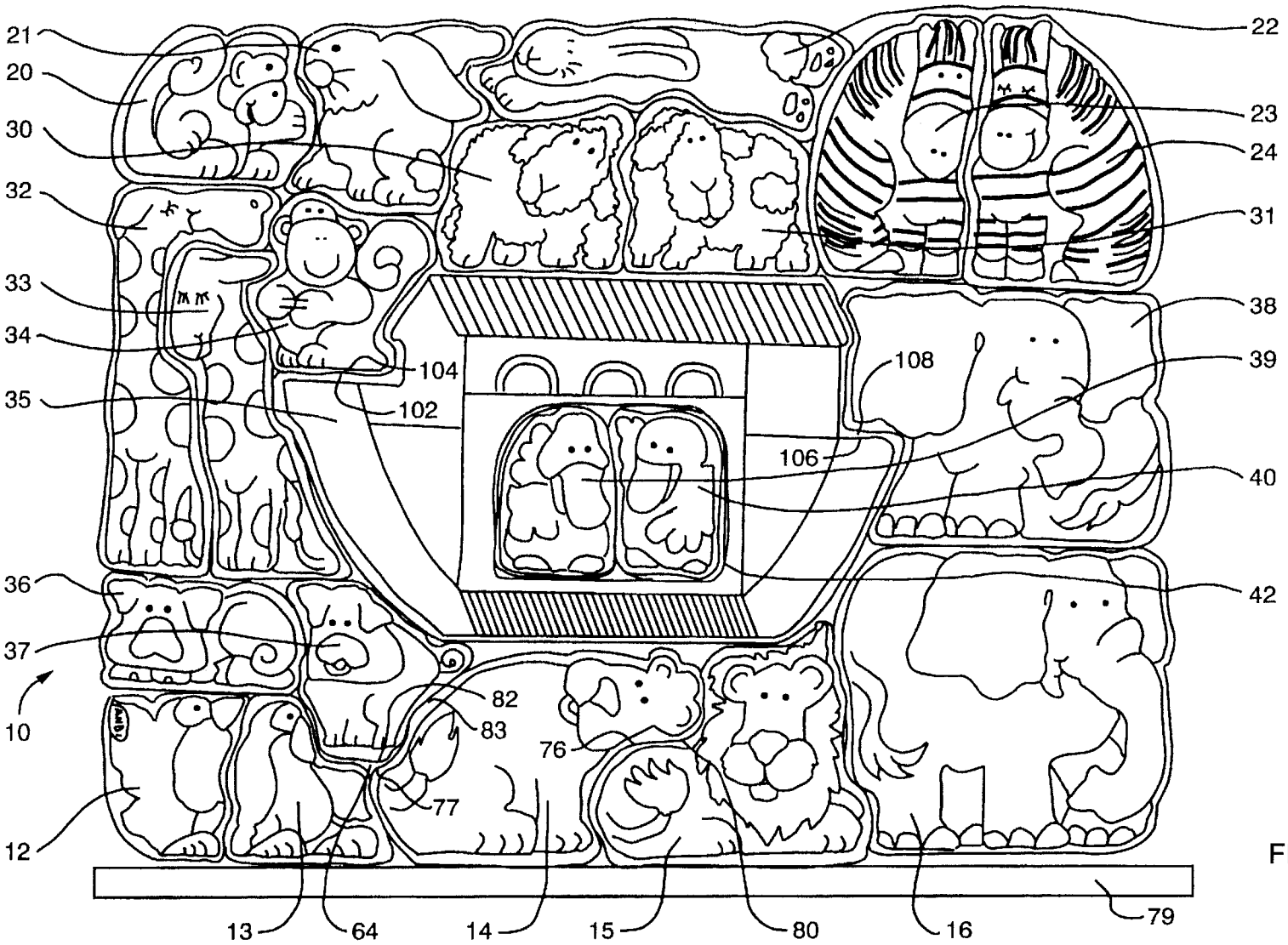
FIG. 1 is a plan view of a puzzle/play set toy product according to this invention.
Figure 2:
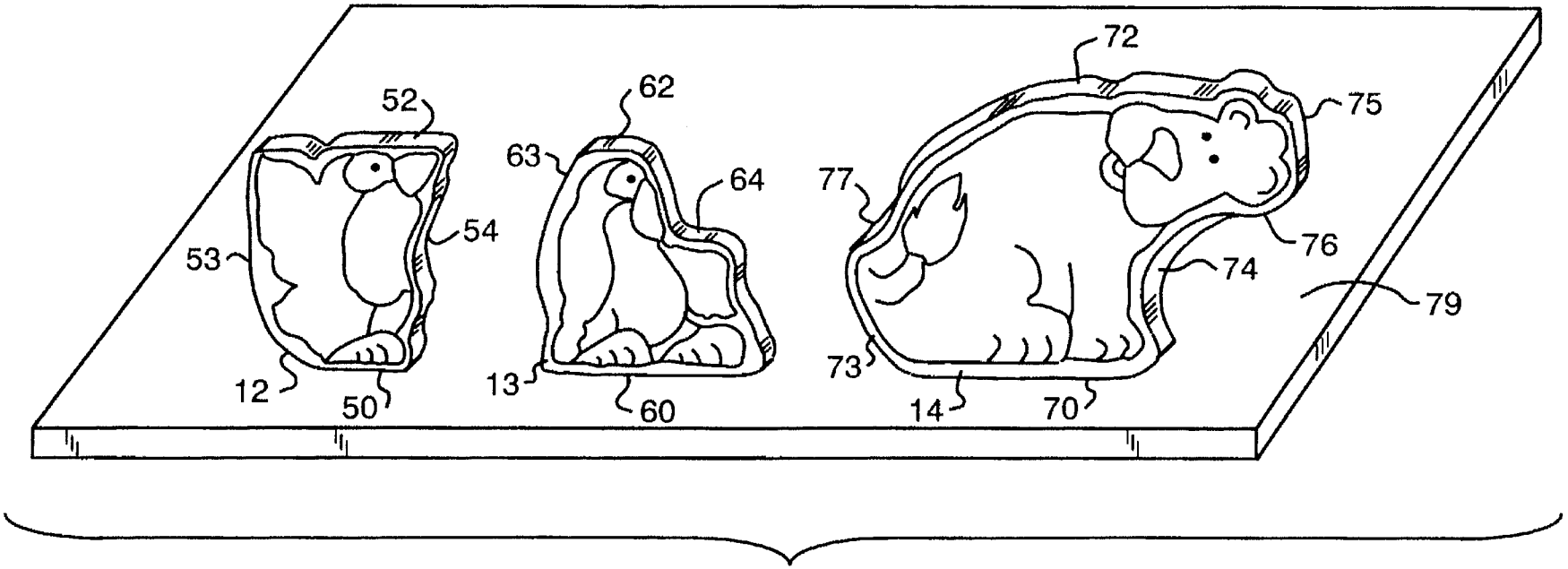
FIG. 2 is a three dimensional view of three of the toy product pieces of FIG. 1 separately standing unsupported on a horizontal surface to illustrate the fact that each piece can be separately played with, individually or in one or more groups.

There is shown in FIG. 1 puzzle/play set toy product 10 according to this invention. Toy product 10 is shown in FIG. 1 fully assembled as a free-standing puzzle forming a vertical scene made up of a number of separate objects and figures, in which each such object and figure is a separate piece of the product that can be played with by itself. The bottom layer of toy product 10 includes pieces 12 and 13 that are printed on their flat upper surfaces to look like penguins. Lions 14 and 15 and elephant 16 make up the remainder of the bottom layer. Pieces 12 through 14 are also shown in FIG. 2, which illustrates that each piece of the toy product is capable of standing unsupported on table top 79, and further that each such piece is configured to represent an entire object or figure so that each piece has meaning to a child. The toy product is thus capable of use as a play set, in which the child can place each piece where desired on a flat surface.

Turning back to FIG. 1, the top layer of toy product 10 comprises monkey 20, rabbits 21 and 22, and zebras 23 and 24. Intermediate pieces include giraffes 32 and 33, monkey 34, pigs 36 and 37, sheep 30 and 31, second elephant 38, and duck pair 39 and 40 that fit within a central cutout in Noah's Ark 35.

Toy product 10 is preferably made from a foamed plastic such as closed-cell polyethylene. In order to achieve the desired thickness of at least approximately ½", multiple extruded foam sheets can be flame-laminated together to make up a sheet having a sufficient thickness. In one embodiment, product 10 is made from two, ½" thick sheets of the material flame laminated together to form the core of the laminate, which is then covered on both sides with a 3/16" thick layer of somewhat more dense foam to provide more rigidity to the finished piece. Graphics may be applied to the laminated foam sheet by applying graphics-covered fabric covers thereon. This may be accomplished by screen-printing a polyester non-woven fabric with the graphics, and flame laminating the fabric to both sides of the laminated sheet. The product could be made of other materials, for example paper-based or wood-based materials. For a product with a relatively large number of pieces such as product 10, it has been found that the material thickness should be preferably at least approximately ½", with a thickness of at least approximately ⅝" having been found to provide more stability so that children of ages 3 to 6 can stand the figures individually, and vertically stand the entire toy product together, without undue difficulty.

The pieces are made free standing by a combination of the overall shape of the piece, the shape of the bottom on which the piece is designed to be stood, and the thickness of the piece. Typically this means that the bottoms of the pieces are relatively flat along a substantial portion of their length, although this objective can also be accomplished with a balanced piece that is designed to touch a flat surface at at least two separate locations. Also, the shapes need to be sufficiently symmetric about a central vertical axis so that they do not tip to one side when they are stood on their bottoms. The exact shape depends on the overall dimensions and other considerations such as bottom shape, the material chosen, and the thickness of the material.

At least some of the pieces of toy product 10 have sides shaped so that they interfit with other pieces along their adjacent sides. This interfitting concept can be defined as follows. An adjacent piece interfits into another piece if a portion of the adjacent piece would protrude into the first piece presuming that the first piece had a side with a regularly-curved shape. This interfitting can be accomplished in the sides and/or top or bottom of at least some of the pieces, although it is important to design the overall shape and the bottom shape of the pieces in such a manner that each piece can stand vertically unsupported on a hard level surface.

The shape of each individual toy/puzzle piece is determined by four considerations. One is the at least to some extent accurate depiction of an object or animal as shown in the figures. Another is the shape of the adjacent pieces and/or the puzzle edge (typically rectangular). A third is the requirement that the pieces stand upright individually, and the fourth is the elimination of dead spaces between the pieces, which requires that the pieces be designed so that they nest compactly together, or one within another.

Knob puzzles present the challenge of fitting positive puzzle shapes into a matching negative frame shape. Jigsaw puzzles have interlocking pieces that require the user to find the adjacent piece or pieces to complete a picture of an object or scene. In contrast to those puzzles, toy product 10 allows the creation of a scene from a number of objects while still fitting the puzzle together shape-to-shape. The bulk and mass of the toy/puzzle pieces eliminates the need for interlocking because the pieces stay in place while the entire puzzle is being fitted together, or stacked vertically.

Non-limiting illustrations of the interfittting concept are shown in FIG. 1 as follows. Lion 15 has a left side almost horizontal area 80 that supports right side almost horizontal area 76 of adjacent lion 14. Similarly, left side somewhat horizontally curved portion 77 of lion 14 supports similarly shaped right side lower portion 83 of pig 37. And, right side portion 64 of penguin 13 supports, or at least is capable of supporting, part of bottom 82 of pig 37. Such interfitting is also shown in ark 35 in which left and right side primarily horizontal side areas 102 and 106 support the bottom of monkey 34 and a portion of the left side 108 of elephant 38, respectively.

The tops of the pieces of toy product 10 below the five top layer pieces are also shaped to support one or more pieces above them. For example, all of the top of sheep 31 and most of the top of sheep 30 are designed to support rabbit 22. Similarly, the top of elephant 38 fully supports zebra 24 and almost entirely supports zebra 23, with just one corner of the zebra supported by a top corner of arc 35. The top of pig 37 supports a portion of giraffe 33, with the other portions supported by pig 36.

FIG. 2 illustrates the fact that each piece of toy product 10 is capable of free-standing vertically on its bottom on horizontal table top 79. Bottom 50 of penguin 12, bottom 60 of penguin 13, and bottom 70 of lion 14 support those pieces to be free standing as shown. The pieces need not be flat as depicted. Since each of the pieces represents graphically, and/or by its shape (for example by molding) an entire object or figure, the pieces can be used as a play set; any one or more of the pieces can be played with individually or together as groupings as desired by the child, limited only by his or her creativity.

The toy product as a whole thus is a combination of a puzzle and a play set. The product is appropriate for children who have the dexterity to assemble the puzzle without the need for a frame, as well as the dexterity to stand the pieces vertically, individually and together as a puzzle. The product's ability to function as a separate play set allows the development of creativity, something not accomplished in traditional knob and jig saw puzzles. Eliminating the need for the pieces to interlock, and designing each piece to be a complete object, allows the child to more easily manipulate the pieces, and also provides an open-ended creative play activity that does not require the child to fit shape-to-shape, or find an adjacent puzzle piece, in order to complete a scene.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A puzzle/play set toy product for assembly into a scene having a predefined perimeter shape, comprising a plurality of separate, unitary, puzzle/play set pieces, each said piece representing an entire object or figure and having edges including a top, a bottom, and sides, with a thickness and a bottom shape that together allow each said piece to be free-standing on its bottom, so that each said piece can be separately played with, in which at least some of said pieces also have a top shape and thickness that allow them to support one or more other pieces above them, and in which said pieces closely interfit with other said pieces along their adjacent edges, at least a portion of the adjacent edges of adjacent pieces following the same contour line so that the pieces fit closely together and fill substantially all of the space defined within the product's predefined perimeter shape, the pieces together forming a multiple-layer scene made up of said plurality of objects or figures represented by said plurality of separate pieces, the entire scene being capable of standing vertically unsupported.

2. The puzzle/play set toy product of claim 1 in which each said piece has a thickness of at least approximately ½".

3. The puzzle/play set toy product of claim 2 in which each said piece has a thickness of at least approximately ⅝".

4. The puzzle/play set toy product of claim 1 in which said puzzle/play set toy product includes a bottom layer of pieces, a top layer of pieces, and pieces between said bottom and top layers, wherein the pieces of said bottom layer and the pieces between said bottom and top layers each have a top shape and thickness that allows them to support one or more pieces above them.

5. The puzzle/play set toy product of claim 1 in which at least one said piece defines an interior opening, and at least one other piece fits entirely within said interior opening to be carried by said one piece.

* * * * *